US005647291A

United States Patent [19]

Hanus et al.

[11] Patent Number: 5,647,291

[45] Date of Patent: Jul. 15, 1997

[54] CATCH THREAD DEVICE FOR SEWING MACHINES

[75] Inventors: Helfried Hanus, Karlsruhe; Uwe Winkler, Ettlingen; Dieter Grossman, Karlsbad, all of Germany

[73] Assignee: G.M. Pfaff Aktiengesellschaft, Kaiserslautern, Germany

[21] Appl. No.: 620,012

[22] Filed: Mar. 21, 1996

[30] Foreign Application Priority Data

Mar. 22, 1995 [DE] Germany ..... 29508368 U

[51] Int. Cl.[6] ..... D05B 69/36

[52] U.S. Cl. ..... 112/278

[58] Field of Search ..... 112/278, 273; 242/37 R; 200/61.18

[56] References Cited

U.S. PATENT DOCUMENTS

| | | | |
|---|---|---|---|
| 4,763,588 | 8/1988 | Rydborn | 112/278 X |
| 5,107,779 | 4/1992 | Arnold et al. | 112/278 |
| 5,237,944 | 8/1993 | Willenbacher et al. | 112/278 X |

*Primary Examiner*—Peter Nerbun

*Attorney, Agent, or Firm*—McGlew and Tuttle

[57] ABSTRACT

A catch thread device is provided for a sewing machine with a scanning element controlled by the upper thread in the rhythm of sewing. The scanning element triggers a signal for the operator and/or for switching off the drive of the sewing machine via an electronic control circuit in the case of a thread break. The catch thread device includes a support fastened to the housing in the sewing machine as well as a pivotable switching lever. The pivotable switching lever is pretensioned and mounted in the support and is connected to the scanning element extending into the course of the upper thread between an eye of the needle and a thread guide of a thread lever of the sewing machine. The scanning element is connected to a magnet which is arranged adjacent to a Hall IC (integrated circuit) fastened to the support wherein the Hall IC is connected via lines to the control circuit for evaluating the signals triggered by the magnet in the Hall IC during the movement of the switching element.

6 Claims, 2 Drawing Sheets

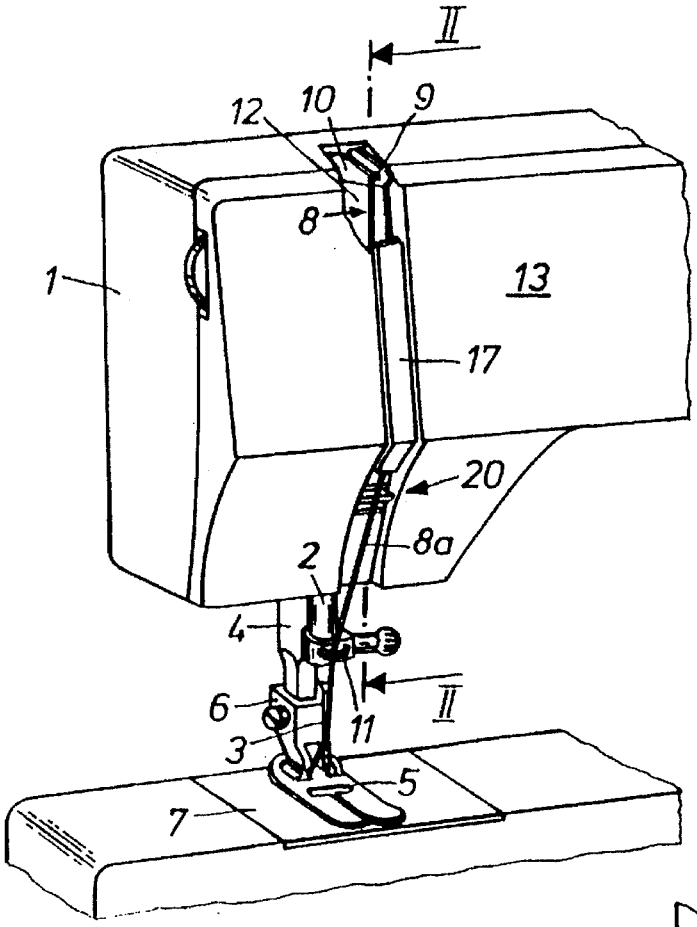
Fig.1
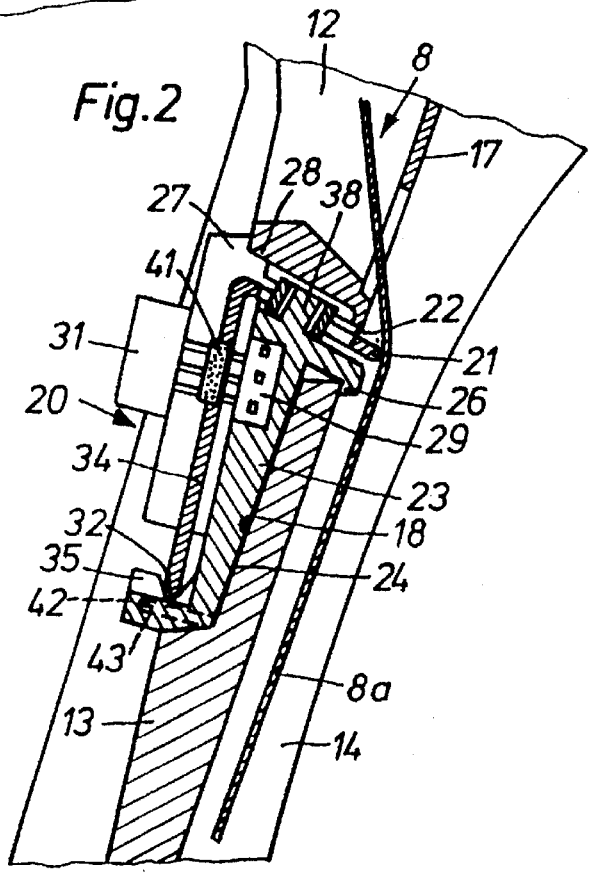
Fig.2
Fig.4
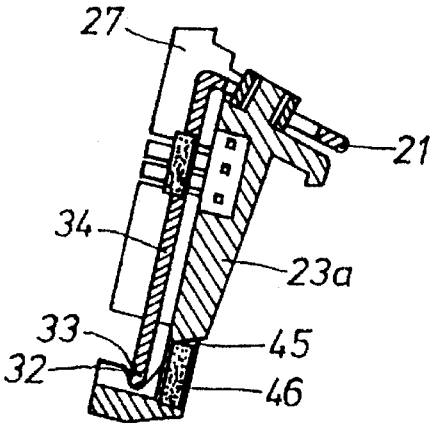

CATCH THREAD DEVICE FOR SEWING MACHINES

FIELD OF THE INVENTION

The present invention pertains to a catch thread device for sewing machines and more particularly to a catch thread device for a sewing machine with a scanning element controlled by the upper thread in the rhythm of sewing, which scanning element triggers a signal for the operator and/or for switching off the drive of the sewing machine via an electronic control circuit in the case of a thread break.

BACKGROUND OF THE INVENTION

The prior-art catch thread devices of this type have switching means, which subject the thread to a high mechanical stress and/or their contacting scanning elements are arranged such that they get dirty easily and therefore operate incorrectly after a certain amount of use. In addition, they have a rather complicated design.

SUMMARY AND OBJECTS OF THE INVENTION

It is an object of the present invention to provide a means for monitoring the upper thread of a sewing machine, which has a simple design, but operates reliably and by which the thread is stressed only insignificantly.

The present invention provides a catch thread device which has a switching means of a far more simple design, which is insensitive to dust generated during sewing and whose movable scanning element does not practically stress the thread.

According to the invention, a catch thread device is provided for a sewing machine with a scanning element controlled by the upper thread in the rhythm of sewing. The scanning element triggers a signal for the operator and/or for switching off the drive of the sewing machine via an electronic control circuit in the case of a thread break. The catch thread device includes a support fastened to the housing in the sewing machine as well as a pivotable switching lever. The pivotable switching lever is pretensioned and mounted in the support and is connected to the scanning element extending into the course of the upper thread between an eye of the needle and a thread guide of a thread lever of the sewing machine. The scanning element is connected to a magnet which is arranged adjacent to a Hall IC (integrated circuit) fastened to the support wherein the Hall IC is connected via lines to the control circuit for evaluating the signals triggered by the magnet in the Hall IC during the movement of the switching element.

The features of the invention including the scanning element forming an end of a right-angle bent part of the switching lever and the support being fastened to the housing in the sewing machine such that a center of gravity of the switching lever is located between its mounting part and the contact point between the scanning element and the upper thread, leads to an inexpensive solution for achieving the necessary restoring force for the switching lever by utilizing the intrinsic weight of this switching lever as the restoring force. The provision of the mount of the switching lever formed by the support points arranged at laterally spaced locations from one another and by the obliquely upwardly directed limitations of the support for two pillow blocks provided at the switching lever as well as providing at least the pillow blocks of the switching lever made of a magnetic material and a magnet fastened to the support under the support points, guarantees reliable supporting of the switching lever even during tilting of the sewing machine.

If the catch thread device is designed with the scanning element formed at the end of the right-angle bend of the switching lever and the support points of the switching lever are made of magnetic material and the magnet is arranged in the support in the adjacent area of mounting of the switching lever located in parallel to the course of the pillow blocks, a reliable and yet nearly uniform restoring and holding force acting on the adjusting lever is generated in a simple manner even under critical machine conditions.

The design of the catch thread device with the right-angle bent part of the switching lever having an opening into which a bolt extends, which is provided on the support and is surrounded by an elastic damping band, leads to an advantageous variant of the switching means.

The measure of providing the support connected to an elastic arm which projects from its basic body, passes through the opening extending into the area of the upper thread in the housing wall of the sewing machine and has two locking elements which come to lie behind the lower wall of the opening and wherein the support has two stop bosses, which are arranged at spaced locations from the locking elements and at laterally spaced locations from one another, and are in contact with the upper wall of the opening, offers an advantageous embodiment for the detachable fastening of the support of the switching means in an opening on the inside of the housing of the sewing machine.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a graphic representation of a front part of a sewing machine;

FIG. 2 is an enlarged sectional view along line II—II in FIG. 1 with the first exemplary embodiment;

FIG. 4 is a sectional view of a design of the second exemplary embodiment that was modified compared with FIG. 2.

DESCRIPTION OF THE PREFERRED EMBODIMENT

Figure 3:
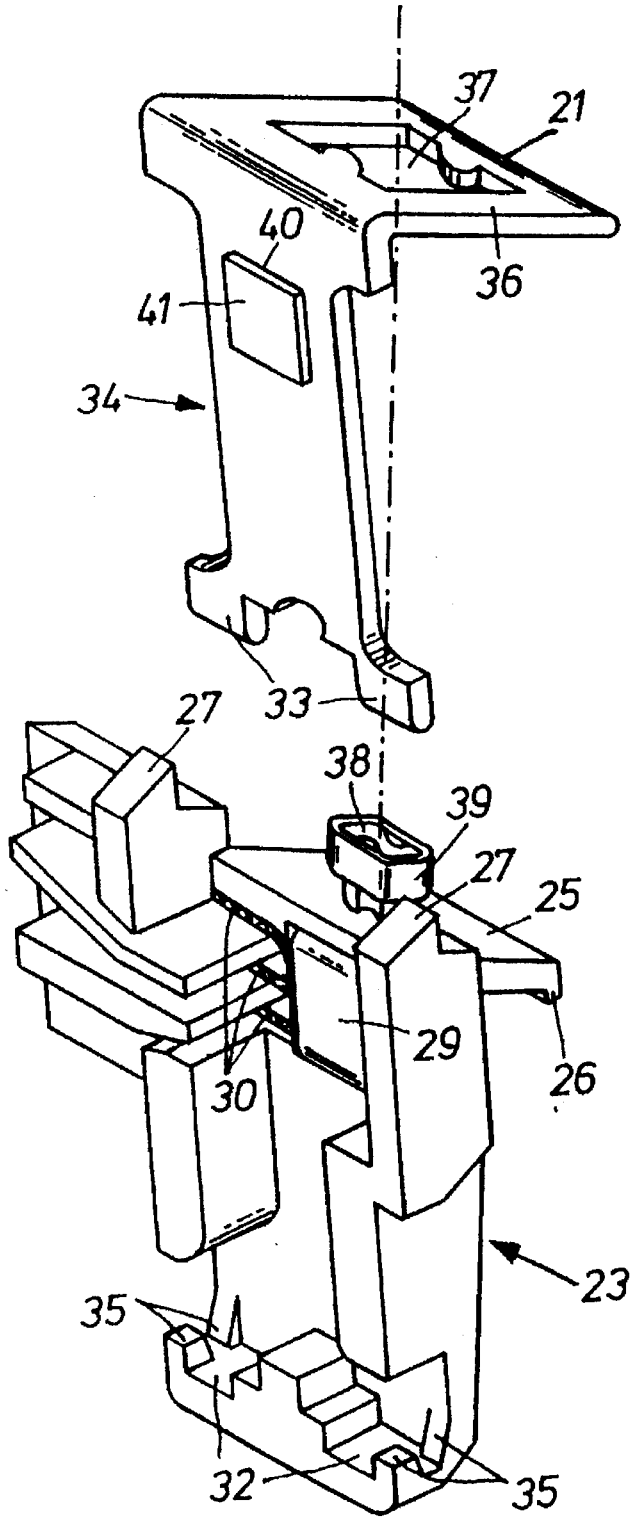
FIG. 3 is an enlarged graphic representation of the catch thread device.

As is shown in FIG. 1, a needle bar 2, which is driven by a drive mechanism, moves up and down, swings out laterally, and carries a needle 3, is mounted in the head 1 of the sewing machine. A pressure bar 4, to which a presser foot 6 provided with a stitch slot 5 is fastened, is mounted behind the needle bar 2 in the known manner. The presser foot is used to press down the fabric to be sewn onto a needle plate 7 during the cooperation of the needle 3 with a shuttle, not shown, which is driven by the driving mechanism of the sewing machine synchronously with the needle 3 through the stitch slot 5. To achieve this, an upper thread 8 extends in the known manner from a thread reserve, not shown, which is provided in the housing of the sewing machine, via a thread-tensioning means, not shown, and a thread guide 9 of a thread lever 10, which is driven by the driving mechanism synchronously with the movement of the needle 3, via a thread guide 11 fastened to the needle bar 2, and finally via the eye of the needle 3 to the fabric to be sewn.

The thread lever 10 is mounted such that its thread guide 9 swings in a slot 12 in the front housing wall 13 (FIG. 2) of the head 1 of the sewing machine. The part of the housing wall 13 under the slot 12 passes over into a groove 14, in which the strand 8*a* of the upper thread 9 leading from the thread lever 10 to the needle 3 extends. The slot 12 is covered to the outside by a cover plate 17. A catch thread device 20, which extends with a scanning element 21 through an opening 22 in the housing wall 13 to the outside into the groove 14 and thus comes into contact with the strand 8*a* of the upper thread 8 extending within the groove 14, is fastened in the head 1 of the sewing machine on the inside of the housing wall 13 in a recess 18 behind the groove 14.

The catch thread device 20 comprises a support 23 (FIGS. 2 and 3) with a rear contact wall 24. An arm 25, on which one locking element 26 each is provided laterally, projects from the top end of the support 23. The support 23 is preferably made of plastic, so that the arm 25 is elastic. Two stop bosses 27, which are located at laterally spaced locations from one another, are provided at the top end of the support 23, spaced apart a distance corresponding to the width of the locking elements 26.

During the installation of the support 23 into the recess 18, the arm 25 with its locking elements 26 is displaced through the opening 22, while the locking elements 26 snap in behind the lower edge of the opening 22 and the stop bosses 27 come into contact with the stop wall 28 in the opening 22. The position of the support 23 in the head 1 is secured as a result; the contact wall 24 comes at the same time into contact with the rear wall of the recess 18.

In the front part, the support 23 contains an opening for a Hall IC (integrated circuit) 29, which is connected via lines 30 to a prior-art electronic control circuit 31.

Two support points 32, which are provided at spaced locations from one another and accommodate one pillow block 33 each of a switching lever 34, are arranged at the lower end of the support 23. The switching lever 34 is made of thin steel plate, which possesses ferromagnetic properties. The pillow blocks 33 are designed as fork-shaped pillow blocks at the switching lever 34 and are each held by two upwardly beveled limitations 35 arranged laterally from the support points 32. The switching lever 34 has a forwardly directed right-angle bend 36 with an opening 37, into which a bolt 38 projecting upward from the support 23 extends. The pivoting movement of the switching lever 34 is thus limited. For damping, the bolt 38 is surrounded with a damping band 39 consisting of rubber. The front part of the right-angle bend 36 extends through the opening 22 in the housing wall 13, and the end edge of the right-angle bend 36 forms the scanning element 21 of the catch thread device 20.

A magnet 41, which cooperates with the Hall IC 29, is fastened in a recess 40 adjacent to the Hall IC 29 in the switching lever 34. In the area of mounting of the switching lever 34, a second magnet 42 is pushed into a pocket 43 of the support 23, which is located between the two support points 32. The possible lifting off of the switching lever 34 from the support points 32 shall thus be prevented.

The support 23 is installed in the head 1 such that the switching lever 34 is slightly inclined in the forward direction, so that it falls forward in its normal position, and the scanning element 21 is pivoted into the path of the upper thread 8. The upper thread is now deflected by the scanning element 21 by about 20°.

The device operates as follows:

The strand 8*a* of the upper thread 8 is tensioned at each stitch during the sewing process, when the thread lever 10 goes up, between the guide 9 of the thread lever and the thread guide 11 and is thus pulled against the scanning element 21 of the catch thread device 20. When the thread lever 10 goes down, the upper thread 8 again separates from the scanning element 21. As a result, the switching lever 34 is rhythmically pivoted to and from. During its movement, the magnet 41 fastened to the switching lever 34 triggers a signal in the Hall IC 29, and this signal is evaluated by the control circuit 31 in the known manner.

If the upper thread 8 breaks, the movement of the switching lever 34 fails to occur, and the Hall IC 29 no longer triggers a signal, as a result of which the control electronic unit 31 triggers an optical or acoustic signal for the operator. The drive of the sewing machine may also be switched off as an option.

Instead of using the intrinsic weight of the switching lever 34 as the restoring force, it is also possible to use a restoring spring or a resetting magnet to press the switching lever 34 into its scanning position.

Especially if the switching lever 34 has a very lightweight design, it may begin to vibrate at very high speeds of the sewing machine as a consequence of the natural vibrations of the sewing machine which thus occur due to unbalanced mass, and it may simulate an incorrect result despite the upper thread being broken. Such an incorrect control is prevented by the exemplary embodiment according to FIG. 4.

A magnet 46 is fastened in this exemplary embodiment in the area of mounting of the switching lever 34 in a recess 45 of the support 23*a* adjacent to the pillow blocks 33 of the switching lever 34. The support 23*a* otherwise corresponds to the support 23 of the first exemplary embodiment, but without the magnet 42 and the pocket 43.

The recess 45 is provided such that the magnet 46 both pulls the switching lever 34 into its end position against the upper thread 8 and prevents the possible lifting off of the switching lever 34 from the support points 32. Due to the magnet 46 being arranged directly next to the area of mounting of the switching lever 34, it is possible to use a relatively strong magnet, whose magnetic force acts both as a restoring force on the switching lever 34 above the mounting point and as a pulling force pulling the switching lever 34 onto the mounting point under the mounting point. The magnetic force of the magnet 46 acting on the switching lever 34 pivots only insignificantly as a consequence of the fact that the pivoting movement of the switching lever 34 is weak in this area.

While specific embodiments of the invention have been shown and described in detail to illustrate the application of the principles of the invention, it will be understood that the invention may be embodied otherwise without departing from such principles.

What is claimed is:

1. A catch thread device for a sewing machine with a sewing machine housing, a needle with needle eye and a thread lever, a thread associated with the sewing machine extending between the thread lever and the needle eye, the catch thread device comprising:

a support adapted to be fastened to said housing;

a pivotable switching lever which is pretensioned and mounted in said support, said switching lever including a long arm, one end of which is mounted in said support and a short part which is bent relative to said long arm and extends substantially at a right angle to said long arm, said long arm having a length which is greater than said short part, said long arm extending substantially vertically and being adapted to extend substantially in parallel to said thread;

a scanning element connected to said switching lever and adapted to extend into a course of said upper thread, between said eye of said needle and said thread lever, said scanning element being provided as an end of said short part of said switching lever, said support adapted to be fastened to said housing of said sewing machine such that a center of gravity of said switching lever is located between a mounting point of said switching lever and a contact point between said scanning element and said upper thread;

a magnet connected to said scanning element;

Hall IC means disposed adjacent to said magnet for generating a signal based on a position of said magnet relative to said Hall IC means; and a control circuit, said Hall IC means being connected via lines to said control circuit, said control circuit for evaluating said signals whereby said scanning element moves rhythmically due to movement of said upper thread resulting in movement of said magnet relative to said Hall IC means for generating said signal.

2. A catch thread device according to claim 1, wherein said short part of said switching lever includes an opening, a bolt being provided extending through said opening, said bolt being provided on said support and being surrounded by an elastic dampening band.

3. A catch thread device for a sewing machine with a sewing machine housing, a needle with needle eye and a thread lever, a thread associated with the sewing machine extending between the thread lever and the needle eye, the catch thread device comprising:

a support adapted to be fastened to said housing;

a pivotable switching lever which is pretensioned and mounted in said support;

a scanning element connected to said switching lever and adapted to extend into a course of said upper thread, between said eye of said needle and said thread lever;

a magnet connected to said scanning element;

Hall IC means disposed adjacent to said magnet for generating a signal based on a position of said magnet relative to said Hall IC means; and a control circuit, said Hall IC means being connected via lines to said control circuit, said control circuit for evaluating said signals whereby said scanning element moves rhythmically due to movement of said upper thread resulting in movement of said magnet relative to said Hall IC means for generating said signal, said support forming a mount for said switching lever including support points arranged at laterally spaced locations from one another and by obliquely upwardly directed limitations of said support, said switching lever including two pillow blocks supported by said obliquely upwardly directed limitations.

4. A catch thread device according to claim 3, wherein said pillow blocks of said switching lever are formed of a a material with ferromagnetic properties and another magnet is fastened to said support under said support points.

5. A catch thread device for a sewing machine with a sewing machine housing, a needle with needle eye and a thread lever, a thread associated with the sewing machine extending between the thread lever and the needle eye, the catch thread device comprising:

a support adapted to be fastened to said housing;

a pivotable switching lever which is pretensioned and mounted in said support;

a scanning element connected to said switching lever and adapted to extend into a course of said upper thread, between said eye of said needle and said thread lever;

a magnet connected to said scanning element;

Hall IC means disposed adjacent to said magnet for generating a signal based on a position of said magnet relative to said Hall IC means; and a control circuit, said Hall IC means being connected via lines to said control circuit, said control circuit for evaluating said signals whereby said scanning element moves rhythmically due to movement of said upper thread resulting in movement of said magnet relative to said Hall IC means for generating said signal, said scanning element forming an end of a right-angle bend of said switching lever, said switching lever having support points made of a material with ferromagnetic properties; and another magnet is arranged in said support in an area adjacent to a mounting location of said switching lever and said support, said switching lever including two pillow blocks having a course of movement based on movement of said switching lever, said magnet being disposed adjacent to said pillow blocks.

6. A catch thread device for a sewing machine with a sewing machine housing, a needle with needle eye and a thread lever, a thread associated with the sewing machine extending between the thread lever and the needle eye, the catch thread device comprising:

a support adapted to be fastened to said housing;

a pivotable switching lever which is pretensioned and mounted in said support;

a scanning element connected to said switching lever and adapted to extend into a course of said upper thread, between said eye of said needle and said thread lever;

a magnet connected to said scanning element;

Hall IC means disposed adjacent to said magnet for generating a signal based on a position of said magnet relative to said Hall IC means; and a control circuit, said Hall IC means being connected via lines to said control circuit, said control circuit for evaluating said signals whereby said scanning element moves rhythmically due to movement of said upper thread resulting in movement of said magnet relative to said Hall IC means for generating said signal; and an elastic arm connected to said support, said elastic arm projecting from said support and passing through an opening in said housing wall and adapted to extend into an area of said upper thread, said support including two locking elements disposed lying behind a lower wall of said opening, said support including two stop bosses arranged at a spaced location from said locking elements and laterally spaced from one another, said two stop bosses being in contact with an upper wall of said opening.

* * * * *